United States Patent [19]

Husted

[11] 4,067,346

[45] Jan. 10, 1978

[54] COLLAPSIBLE HUNTING BLIND

[76] Inventor: Guy L. Husted, 156 E. 2nd St., Lansdale, Pa. 19446

[21] Appl. No.: 688,969

[22] Filed: May 24, 1976

[51] Int. Cl.[2] ..... A45F 1/16

[52] U.S. Cl. ..... 135/4 R; 135/15 PQ

[58] Field of Search ..... 135/4 R, 5 B, 8, 15 PQ

[56] References Cited

U.S. PATENT DOCUMENTS

| | | | |
|---|---|---|---|
| 907,032 | 12/1908 | Gohen | 135/4 R |
| 1,385,615 | 7/1921 | Hammond | 135/4 R |
| 1,450,143 | 3/1923 | Dillman | 135/4 R |
| 1,840,689 | 1/1932 | Baker | 135/15 PQ |
| 2,159,273 | 5/1939 | Killinger | 135/4 R |
| 3,052,250 | 9/1962 | Moss | 135/3 R |
| 3,133,549 | 5/1964 | Severing | 135/15 PQ |
| 3,525,290 | 8/1970 | Pelsue | 135/4 R |

FOREIGN PATENT DOCUMENTS

| | | | |
|---|---|---|---|
| 1,040,978 | 10/1953 | France | 135/4 R |
| 15,851 of | 1887 | United Kingdom | 135/5 B |

*Primary Examiner*—Werner H. Schroeder
*Assistant Examiner*—Conrad L. Berman

[57] ABSTRACT

A collapsible hunting blind is made up of sectional corner posts which are hinged together at their sides so the sections can be folded against each other, divisional top struts which press the tops of the posts apart and which have pins through them so each slat can be folded on itself, and an enclosing cover which is reversible and has different designs on its opposite sides.

9 Claims, 13 Drawing Figures

Figure 6:
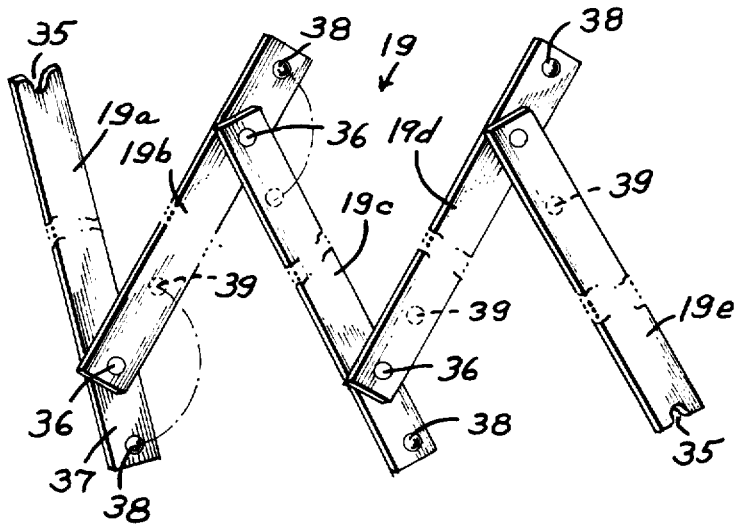

FIG.1
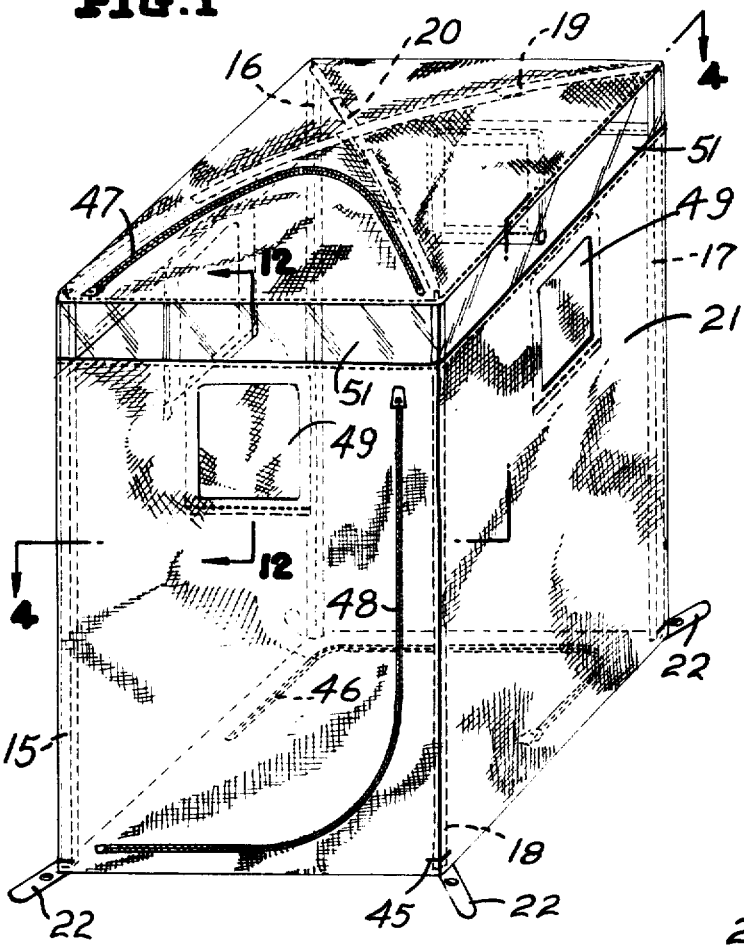
FIG.2
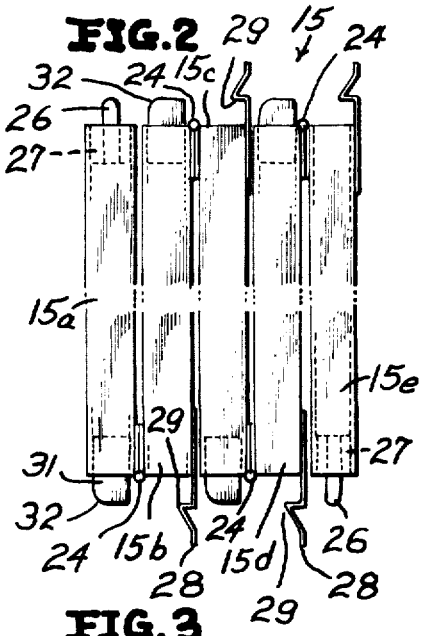
FIG.3
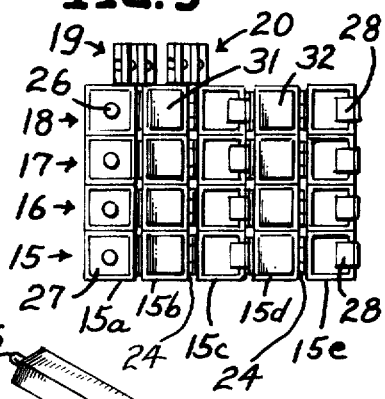
FIG.4
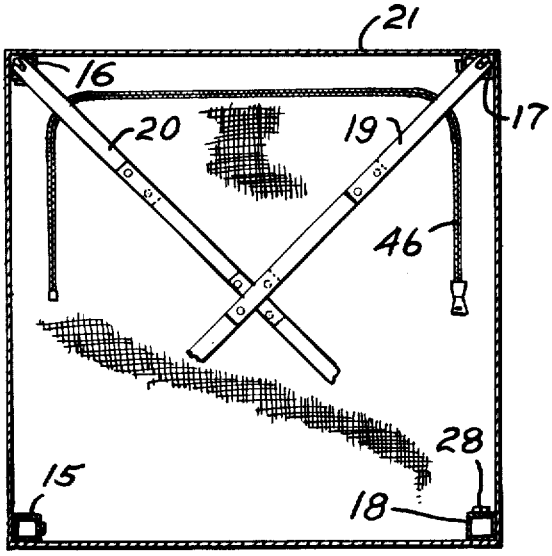
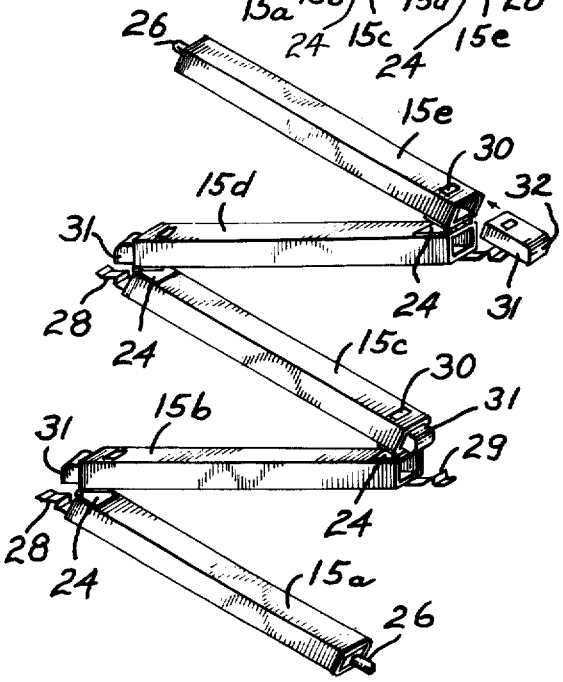
FIG.5

COLLAPSIBLE HUNTING BLIND

This invention relates to hunting blinds, such as the commonly called, "duck blinds" and particularly to a tent-like structure which can be folded or collapsed into an extremely small size package so that it can be carried about conveniently.

The blinds are commonly used, for instance, in hunting wild ducks and geese as the hunter looks for the birds from within the relatively small enclosure which shields him from observation by them. The birds will come much closer to him than they would if they could see him and consequently his chances of a successful gun shot are greatly increased. Hunting blinds are also used to avoid scaring away wild animals such as deer which are being hunted. They are also used for observation of wild fowl and animals, such as "bird-watching", when there is no intention of shooting the creatures. The term, "hunting blind", is generally used to refer to these different uses of the structure and in fact, it may be used merely as a resting or sleeping enclosure.

There exists a great need for a portable hunting blind which is light in weight and foldable to a small size so that it can readily be carried to a selected location. This may be a spot in the woods or forest, in a field or at a water area and frequently, the person wants to move from one place to another in the hope of being at a better location to carry out his intentions. To facilitate this mobility the hunting blind should be capable of being collapsed into a small package size which is light in weight. Its reassembly into a tent-like structure should be quickly and easily accomplished. The structural parts must be easy to manufacture out of inexpensive material and at a low total cost.

In accordance with the present invention, a portable, collapsible, inexpensive hunting blind is provided. It is foldable into a compact size and it can be carried about as easily as though it were a small piece of hand luggage. It can be quickly and easily opened up to a tent formation which is a quite rigid structure in which a person can comfortably sit. Windows are provided entirely around the blind at eye level and hinged flaps are provided which can be opened to shoot through or to take camera pictures, or to have a clear view such as with the use of binoculars. A large top flap opening is provided so that a person can stand up for a better shot and a large side flap opening is provided to make it easy to get in and out of the structure. The bottom fabric can have a flap in it so that a person can fish through a hole in the ice.

The invention includes the feature that the two surfaces of the fabric are painted to have a different appearance and that either surface can be presented outwardly. One surface could have a camouflage painting on it so that it has the appearance of bushes or trees on it and it will blend in with the outdoors. The other surface could be painted red or fluorescent so that when it is turned outwardly it will serve as a warning to other hunters to not shoot in its direction. The entire fabric covering can be turned inside-out to present the desired surface outwardly.

The blind is additionally provided with foot means which are adapted to various ways of fastening the blind to the ground or to an ice surface. For instance, these feet may be pegged or weighted down or they may be frozen in the ice. The feet may be disposed outwardly of the enclosure irrespective of which surface of the fabric covering is presented outwardly.

Figure 7:
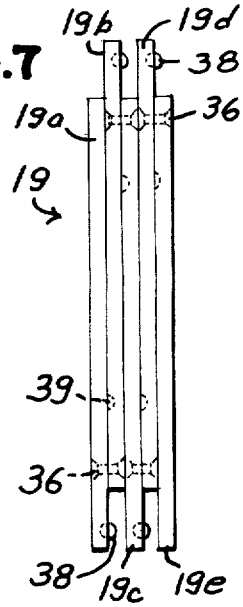
Figure 8:
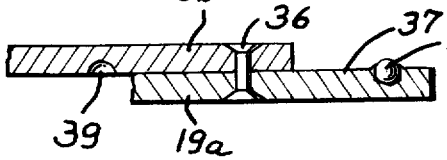
Figure 9:
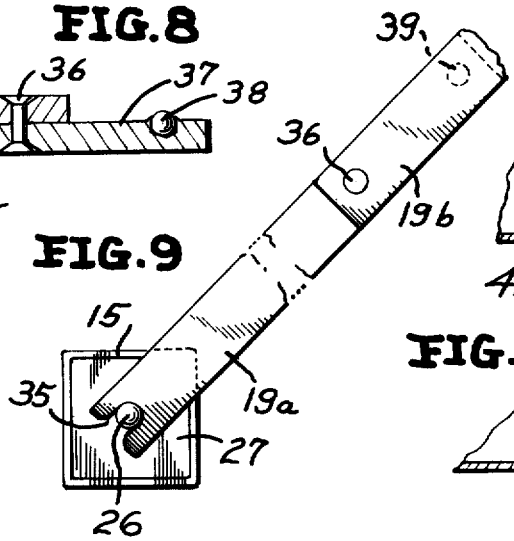
Figure 10:
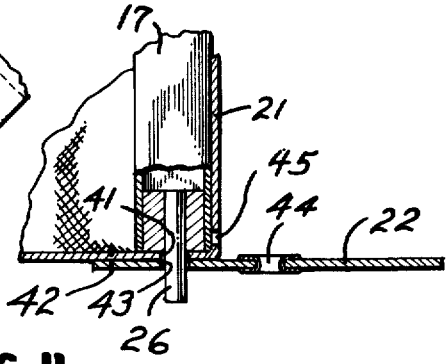
Figure 11:
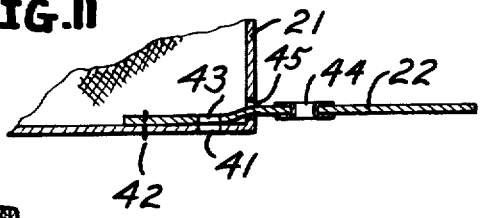
Figure 12:
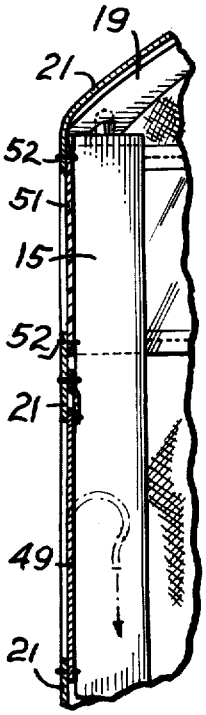
Figure 13:
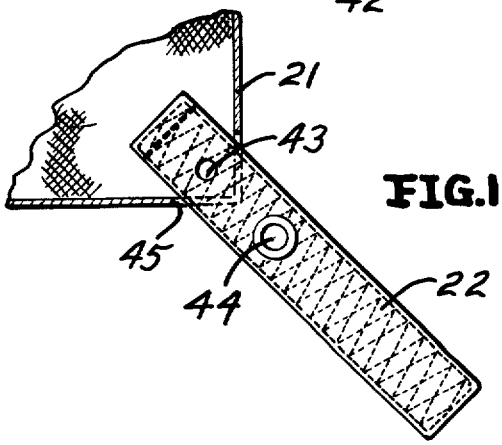

A preferred embodiment of the invention is illustrated in the accompanying drawings in which:

FIG. 1 is a perspective view of the hunting blind in its opened or tent-like formation, FIG. 2 is a side elevational view of the bundle shown in FIG. 3 of structural parts which have been collapsed, folded and grouped together, FIG. 3 is a top side or plan view of the bundle of structural parts described for FIG. 2, FIG. 4 is a sectional view on the line 4—4 of FIG. 1, FIG. 5 is aperspective view of one of the corner posts in a partially collapsed position, some parts being displaced or omitted to better show the structure, a perspective FIG. 6 is a perspective view of one of the top spreader bars, FIG. 7 is a side elevational view of one of the spreader bars folded upon itself, FIG. 8 is an enlarged side elevation of a spreader bar at its pivot pin, FIG. 9 is an enlarged plan view of the top of one of the corner posts and part of a spreader bar, FIG. 10 is a fragmentary elevational view of the lower end of one of the corner posts, FIG. 11 is similar to FIG. 10, the fabric having been turned inside out and the post being omitted, FIG. 12 is a fragmentary sectional view on the line 12—12 of FIG. 1 and FIG. 13 is a plan view of one of the foot tabs.

As is stated in the description of the drawings, FIG. 1 illustrates the appearance of the hunting blind in its expanded, set-up assembly form for occupancy by a hunter, bird watcher, photographer, etc. It is of tent-like formation and generally is of a size to admit a single person. FIGS. 2 and 3 show the frame structural parts after they have been folded up and grouped together side-by-side to form a compact bundle. Ordinarily, the fabric sheeting of the blind will be wrapped around the bundle shown in FIGS. 2 and 3 to make a composite package which easily can be carried about as though it were a small luggage piece.

The scale of FIGS. 2 and 3 is several times greater than the scale of FIG. 1 in order to show structural details. With this in mind, it is apparent that the composite package of FIGS. 2 and 3, with the fabric covering wrapped around it, is very small compared to the tent-like size of FIG. 1. Although the illustrated structure is intended for occupancy by a single person it is apparent that it can be made large enough for two or more persons but this reduces the portability of the knocked-down package.

The blind is made up of a minimum number of parts. There are four collapsible corner posts 15, 16, 17 and 18, two foldable top spreader bars or struts 19 and 20, and the six paneled covering material 21 having feet 22 attached to its four lower corners. A feature of the invention is that preferably, the four corner posts are all alike and the two struts are both alike. Preferably, the opened-up tent assembly is square in horizontal cross-section as is shown in FIG. 4 and its heighth is slightly greater than its width. Obviously, the assembly can be oblong in horizontal cross-section and the heighth may be less than or greater than the relative proportions shown in the drawings.

The corner post 15, which, as stated above, is identical to posts 16, 17, and 18, is shown in partially collapsed position in FIG. 5 and in fully collapsed position in FIGS. 2 and 3. It is made up of end sections 15*a* and 15*e* and middle sections 15*b*, 15*c*, and 15*d* but there may be more or fewer middle sections. Preferably, the sections are all of the same length so as to form the compact group of FIG. 2. Preferably, the post is square in cross-section and it is tubular to make it light in weight. Aluminum is a most suitable material for the corner posts to reduce its weight.

There is a hinge 24 on opposite sides of each middle section 15*b*, 15*c* and 15*d* as this makes it possible for them and the two end sections 15*a* and 15*e* to fold flat against each other as is shown in FIGS. 2 and 3. The hinges 24 may be attached, for instance, by self threading screws (not shown). The hinge pins are at the ends of the post sections and are transverse to the post length so the sections will fold flat against each other. This flat-wise, collapsed association of the sections of each post is an important feature of the invention as a minimum space is occupied by each post.

The end sections 15*a* and 15*e* are provided with axially positioned studs or pins 26 which project beyond the ends of the posts. As here shown, the pins 26 are integral with and project from a block 27 which is forcibly and securely driven into or is otherwise fastened within the open end of each section 15*a* and 15*e*. All four corner posts should have these pins at both ends. The bottom pins are intended to be forced or driven into the ground as is evident from FIG. 10. The top pins are to engage with the top spreader bars 19 and 20 as is shown in FIG. 9, as will be explained. As they are the same, it does not matter whether section 15*a* or 15*e* is at the bottom.

To hold the sections of each corner post in an extended or in-line position to form a straight post, spring clips or latches or equivalent catches are provided, as shown at 28. One of the clips is fastened, as by self threading screws (not shown) on the side of each post section opposite from the hinge, and each clip has an offset or hooked end 29 to engage in an opening or notch 30 of the opposing post section. When the post sections are straightened out, the hooked ends 29 engage in the openings 30 to thereby hold the sections in this straight line assembly. To collapse the post to the folded position of FIGS. 2 and 3 the hooked ends 29 are simply withdrawn outwardly from the opening 30 so that the clips are released and the sections can be folded against each other.

To further stabilize and strengthen the posts when they are straightened out, the invention includes the provision of the stabilizing block inserts 31 at alternate ends of the post sections. Each one is a cross-sectional size to be driven forcibly into or be otherwise fastened in the section end so it is retained in place. Each stabilizing block projects beyond the section holding it so that it will enter the opposing section when the post is straightened out; this projecting end should be slightly smaller so that it will snugly but not forcibly fit in the post section it is to enter.

The face of the stabilizing block 31 which is opposite from the adjacent hinge must be curved as shown at 32. This curve is on a radius having the hinge pin as its center so that the edge of the coacting post section will pass over this curved face without a binding action. The stabilizing block 31 should have a notch or recess therein (not shown) opposite the opening 30 to admit the end 29 of the latch 28. When the corner posts are straightened out these stabilizing blocks will prevent or resist relative twisting and swaying of the post sections and reduce the stress on the hinges and latches.

It is preferable that the corner posts be duplicates to simplify construction costs and any needed replacements. If the post sections are uniform the posts collapse into a more compact shape. As is stated above, if the post ends are identical, the assembly into a tent is made easier as the person does not have to pay attention to which end of the corner post is up.

The spreader bar 19 in FIGS. 6, 7 and 8 is representative of the two bars 19 and 20 as they preferably are duplicates of each other. The spreader bar 19 is made up of the two end sections 19*a* and 19*e* and the middle sections 19*b*, 19*c* and 19*d*. Each section should have about the same length to simplify manufacture and each section should have about the same length as each section of the corner posts so that the folded assembly of FIGS. 2 and 3 has about the same overall length. This may require that the spreader bar have more or fewer sections than the number of sections in the corner posts.

The extreme ends of the end sections 19*a* and 19*e* are notched at 35 to receive the top pins 26 of the corner posts. Instead of the notches, holes could be made through the ends of the end sections and they should be large enough to freely receive the pins 26. When the sections of each spreader bar are straightened out and they are positioned across the top of the tent in the diagonal manner shown in FIG. 1, they will serve to hold the tops of the corner posts apart from each other. The spreader bars should be slightly longer than the diagonal measurement of the top panel of the fabric so that the spreader bars will bow upwardly at the center. This will keep the fabric tight, it will constantly press the tops of the corner posts apart from each other and will serve more effectively to shed rain water.

The spreader bars 19 and 20 are slat-like in structure in that they are broader than thick in cross-section and the sections are disposed flatwise against each other as in a folding carpenter's rule. The sections of each spreader bar are pivoted together by pivot pins which pass transversely through the sections. The pivot pin connecting sections 19*a* and 19*b* together is located inwardly from the end of section 19*a* and is at the adjacent end of section 19*b*, so that a portion of section 19*a* extends beyond the pin 36. When the sections are opened up to a straight line form, this projecting portion 37 underlied and bears against the section 19*b* to give added strength at this pivot point. This same strengthening structure is carried out at the other pivot pins 36.

Near the end of the projecting portion 37 is a ball 38 which is located in a cavity or recess therein. Beneath the ball is a spring (not shown) to urge the ball outwardly and the ball is retained against complete dislodgement by peening around the edge of the recess in known manner. The ball 38 may be a small steel ball bearing and the portion of it extends above the surrounding face of the section. When the sections of 19 and 20 are straightened out, the ball 38 lodges in a mating recess 39 in the under face of the section 19*b*. This engagement of the tops of the balls 38 in the recesses 39 serves to keep the sections in their straight-line formation and to resist their collapsing.

Other means may be provided to releasibly retain the sections of the spreader bars in their straight-line formation but the described ball and socket provision is considered to be superior. This makes it possible to form the compact folded arrangement shown in FIG. 7. FIG. 3 also shows the minimal amount of space taken up by the folded spreader bars 19 and 20 when they are placed with the collapsed corner posts.

The fabric covering 21 may be any sheet material which sheds water and any one of the modern so-called space-age materials is preferred. Canvas is a suitable material but it is preferable that it be a synthetic plastic which is water proof and thin so that it is light in weight. It is made up of six panels, sewn or cemented together where required, to include the four sides, a floor and a top roof. There should be holes 41 at the corners of the floor, so that the bottom pins 26 of the four corner posts can pass through them and into the ground, as shown in FIG. 10. This also serves to keep the floor material spread out and flat.

FIG. 10 also shows one of the foot tabs 22 which is secured as by stitching 42, at the bottom corners of the fabric. Each tab has a hole 43 through it for the pin 26 to pass through and it has another hole 44 outside of the tent for a stake to be driven through. These foot tabs 22, as shown in FIG. 13, are long so that they may be held in place on the ground by large stones. If the blind is to be located on a frozen water surface, as a pond, these foot tabs can be frozen in the ice.

It has been stated above that the two sides of the covering material 21 may be differently colored. One side can be painted so that it blends in with bushes or trees and the other side may be red so that it will be a warning to hunters. When the fabric is turned inside out from FIG. 10 to FIG. 11, the foot tabs 22 are drawn out through the holes 45 at the bottom corners of the fabric so that the tabs will be on the outside.

To make it possible for a person to fish through the bottom of the blind, a zipper 46 or like fastener is attached to the bottom fabric so that a flap can be opened up of a preselected size. The top or roof has a zipper 47 which provides an openable flap through which a person can stand up when it is moved aside. One of the side panels should have a zipper 48 in it to form a flap opening through which a person gets in and out of the blind. Zippers of an inverted U-shape form small flaps in each side panel so that a seated person can open them to take photographs or to use binoculars. These small flaps 49 are shown in FIGS. 1 and 12.

To make it possible for a person who is seated in the blind to look about in all directions, a clear plastic 51 is secured as by stitching 52 at the tops of the side panels; see FIG. 12. The length or heighth of this clear plastic 51 may be greater then or smaller than the relative size shown in the drawing.

The steps to form the opened-up blind of FIG. 1 are quite simple and a preferred way is the following:

A. Unroll the covering fabric from the frame bundle

B. Spread out the floor panel on the ground or ice and anchor the feet as by placing stones on them C. Unfold all four of the corner posts and both spreader struts to their full lengths D. Step inside through the door flap and insert the lower pin 26 of each corner post in a hole 41 at the corners E. Install the two spreader struts, diagonally across the top corners, engaging the end notches 35 with the pins 26 at the tops of the posts F. Press the centers of the struts upwardly to bow them and create a crown in the roof panel, for drainage purposes.

The disassembly and collapse of the expanded blind is accomplished by reversing the order of the set-up procedure. The parts are assembled together to form the bundle shown in FIGS. 2 and 3. The cover fabric is wrapped around this bundle to form a compact package and a string or cord will hold it together so that it can easily be carried.

I claim:

1. A hunting blind comprising four substantially vertical corner posts, each including a succeeding series of first and second sections, a hinged connection on one side of the post between each first and the next second section, a hinged connection on the other side of the post between each second and the next first section so that the hinged connections alternate on opposite sides of the post along its length, each hinged connection including a hinge pin which is transverse to the post length and is at a face of the post so the sections will fold flat against each other in a compact assembly but are in a straight line in their extended position to form the post, the end sections having axially projecting pins extending upwardly and also extending downwardly therefrom, spring latch means on the abutting first and second sections at the faces of the sections opposite from the hinged connection at said first and second section ends, said latch means including a notch therein into which the latch mechanically snaps for releasibly locking the sections together in an extended straight line position; two top struts, each including divisions which are pivoted together so that the divisions may be folded together in a compact assembly or be extended into a straight line, the struts crossing but being unconnected to each other and extending diagonally across the top of the blind, the struts having openings at their ends receiving the top pin of the adjacent corner post, each strut being slat-like in structure with transverse pins pivotally connecting them together so that the divisions swing to positions flatwise against each other when they are collapsed; means for yieldably retaining the divisions in a straight line position so that each strut presses the tops of the corner posts apart, said retaining means including a ball carried by one division and a recess on the adjacent division positioned to receive the ball; and a covering material enclosing and forming a tent about said posts and said struts.

2. The hunting blind of claim 1 in which said corner posts include stabilizing blocks projecting from the sections at their hinged ends and fitting within receiving sockets at the ends of the meeting sections to resist axial twisting.

3. The hunting blind of claim 1 in which the covering material includes transparent window material entirely around the blind for outside 360° observation.

4. The hunting blind of claim 1 in which the covering material is reversible and is differently designed on its opposite sides.

5. The hunting blind of claim 1 in which attachment feet are fastened to the bottom corners of the covering material and the covering material has openings therethrough for exterior location of the feet irrespective of which side of the covering material is on the outside.

6. A collapsible corner post for a hunting blind comprising a succeeding series of first and second sections, a hinged connection on one side of the post between each first and the next second section, a hinged connection on the other side of the post between each second and the next first section so that the hinged connections alternate on opposite sides of the post along its length, the hinged connections including hinge pins which are transverse to the post length and are at a face of the post so the sections will fold flat against each other in a compact assembly but are in a straight line in their extended position to form the post, and spring latch means on the abutting first and second sections at an end adjacent to the next first section and at the faces of the second sections opposite from the hinged connection at that end, said spring latch means including a notch therein into which the latch mechanically snaps for releasibly locking the sections together in the straight line extended position.

7. The post of claim 6 which additionally has a stabilizing block projecting from the section ends which meet another section end, said stabilizing blocks fitting within receiving sockets at the ends of the meeting section.

8. The hunting blind of claim 1 in which the roof portion of the covering material has an openable flap therein.

9. The hunting blind of claim 1 in which the covering material includes a floor portion having an openable flap therein.

* * * * *